US005261209A

United States Patent [19]

Focke et al.

[11] Patent Number: 5,261,209

[45] Date of Patent: Nov. 16, 1993

[54] PROCESS AND APPARATUS FOR PRODUCING HINGE LID PACKS WITH COLLARS

[75] Inventors: Heinz Focke; Helmut Granz, both of Verden, Fed. Rep. of Germany

[73] Assignee: Focke & Co., (GmbH & Co.), Verden, Fed. Rep. of Germany

[21] Appl. No.: 824,351

[22] Filed: Jan. 23, 1992

[30] Foreign Application Priority Data

Jan. 24, 1991 [DE] Fed. Rep. of Germany ..... 4102005

[51] Int. Cl.[5] ..... B65B 19/14; B31B 17/26

[52] U.S. Cl. ..... 53/410; 53/128.1; 493/911

[58] Field of Search ..... 53/410, 135.2, 135.1, 53/128.1; 493/911, 359, 355, 399, 398, 397, 94, 60, 59, 68, 409, 408

[56] References Cited

U.S. PATENT DOCUMENTS

| | | | |
|---|---|---|---|
| 3,844,201 | 10/1974 | Eggert et al. | 493/355 |
| 3,956,865 | 5/1976 | Schmermund | 53/234 X |
| 3,967,543 | 7/1976 | Seragnoli | 83/152 X |
| 4,612,756 | 9/1986 | Focke et al. | 53/234 X |
| 4,708,704 | 11/1987 | Focke et al. | 493/911 X |
| 4,730,442 | 3/1988 | Focke et al. | 53/234 X |
| 4,938,005 | 7/1990 | Focke | 493/911 X |

FOREIGN PATENT DOCUMENTS

| | | | |
|---|---|---|---|
| 87483 | 2/1982 | European Pat. Off. . | |
| 2259148 | 6/1974 | Fed. Rep. of Germany | 493/911 |
| 3515775 | 11/1986 | Fed. Rep. of Germany . | |
| 3522614 | 1/1987 | Fed. Rep. of Germany . | |
| 3800664 | 7/1989 | Fed. Rep. of Germany . | |
| 3931310 | 6/1990 | Fed. Rep. of Germany . | |
| 2348134 | 11/1977 | France . | |
| 678393 | 9/1952 | United Kingdom . | |
| 1467429 | 3/1977 | United Kingdom . | |

*Primary Examiner*—James F. Coan

*Attorney, Agent, or Firm*—Sughrue, Mion, Zinn, Macpeak & Seas

[57] ABSTRACT

In the production of hinge lid packs with rounded longitudinal edges, collars (10) which are present in this type of pack are preshaped in the region of longitudinal edges (13) which are also rounded. For this purpose, a scoring (embossed strip 21, 22) which extends in the longitudinal direction is applied to a web of material (14). Thereafter, the collars (10) are severed from the web of material (14) and are preshaped in the region of the longitudinal edges (13) which are to be formed. The collars (10) which have been prepared in this way can be placed on a cigarette block and be further processed in the conventional manner.

9 Claims, 4 Drawing Sheets

PROCESS AND APPARATUS FOR PRODUCING HINGE LID PACKS WITH COLLARS

BACKGROUND OF THE INVENTION

The invention relates to a process for producing hinge lid packs in which a collar comprising a collar front panel and collar side tabs projects from a pack part of the hinge lid pack, in which process said collar is placed in the form of a separate blank onto the top side of a cigarette block (a cigarette group wrapped in an inner blank made of tin foil) and the projecting collar side tabs are folded against side faces of the cigarette block which is then introduced into the hinge lid pack together with the folded collar. Furthermore, the invention relates to an apparatus for conducting the process.

Hinge lid packs are widely used as cigarette packs. They comprise a pack part and a lid hinged to a rear panel of the pack part. A collar, which is arranged in the pack part, is normally formed from a separate blank and comprises a collar front panel and collar side tabs.

Recently, hinge lid packs of this kind have appeared, in which the longitudinal edges are bevelled or polygonal (U.S. Pat. No. 4,753,383 and U.S. Pat. No. 4,753,384). In this pack type, upright longitudinal edges which are formed between, on the one hand, the collar front panel and, on the other hand, the collar side tabs, have to correspond to the shape of the longitudinal edges of the pack, i.e. they have to be rounded, bevelled or polygonal.

SUMMARY OF THE INVENTION

The invention is concerned with producing and preparing the (separate) blank for the collar in such a way that the introduction of the collar into the pack (hinge lid pack) is expediently integrated into the overall packaging process. The invention is based on the object to produce, prepare and feed blanks for the collar of hinge lid packs with rounded, bevelled or polygonal edges in such a way that the collar can be introduced into the pack together with the pack contents (cigarette block) in the conventional way, even though the edges have a different structure.

To attain this object, the process according to the invention is characterized in that the collar is preshaped by means of pivoting the collar side tabs in the region of the longitudinal edges so as to form rounded or polygonal longitudinal edges, and in that the collar is reshaped so as to resume a (nearly) extended flat shape and is then fed to the cigarette block (pack contents).

According to the findings of the invention, collars for packs with specifically designed longitudinal edges can be processed in the conventional manner, if the collar is pretreated in a particular way, specifically if the longitudinal edges of the collar are preshaped such that they are rounded or polygonal and are then reshaped to resume their flat shape which is required for further transport and handling of the collar in the normal way.

According to a further feature of the invention, the collar is preshaped in two steps. A web of material, from which the collars are severed, is pretreated in the region of the longitudinal edges (which are to be formed at a later stage). In particular, the web of material is prepared for the preshaping step following at a later stage by being embossed. In the case of round edges, this embossment comprises a plurality of parallel and longitudinally directed grooves, which are applied to the web of material in its longitudinal direction in the region of two strips by means of appropriate scoring tools. Preferably, the grooves are formed into the web of material from two sides, i.e. from the bottom and the top. Thereafter, the individual collars are severed from the web of material and are preshaped in the region of a shaping station by means of a deflection of the collar side tabs relative to the (horizontally directed) collar front panel. Subsequently, the collar side tabs are moved back so as to resume the horizontal, i.e. flat shape.

The apparatus for pretreating or producing the collars comprises an embossing station for pretreating the web of material, a cutting station for producing the collars and a following shaping station, in which the actual preshaping of the collars is performed. Then, the collars treated in this way are fed to the pack contents (cigarette block).

BRIEF DESCRIPTION OF THE DRAWINGS

According to the invention, the embossing station and the shaping station are designed in a specific way and are provided with specific means.

An exemplary embodiment will be described below in detail with reference to the drawings, in which.

DESCRIPTION OF A PREFERRED EMBODIMENT

Figure 1:
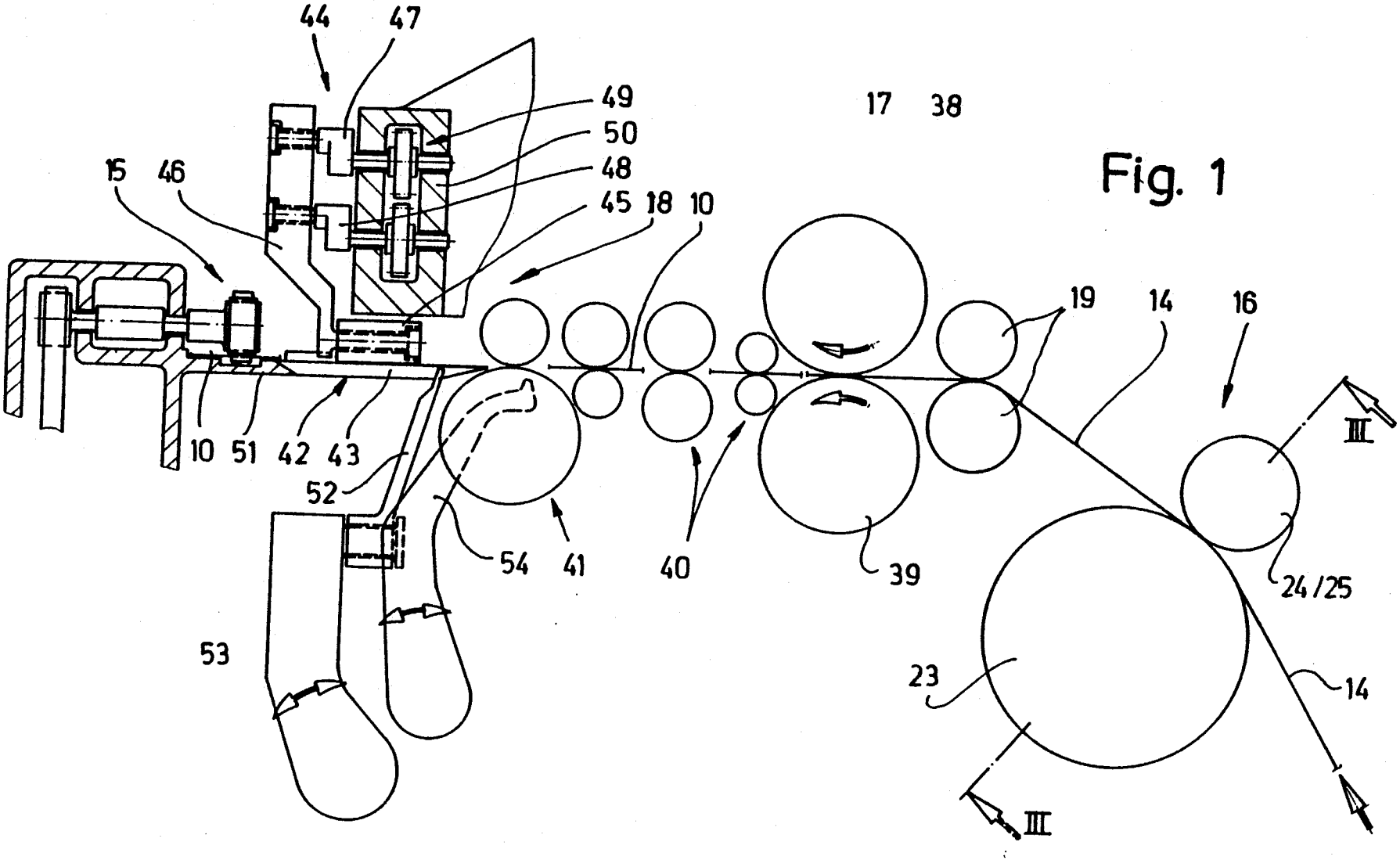
FIG. 1 shows a schematic side view of an apparatus for producing and preshaping blanks for collars.
Figure 2:
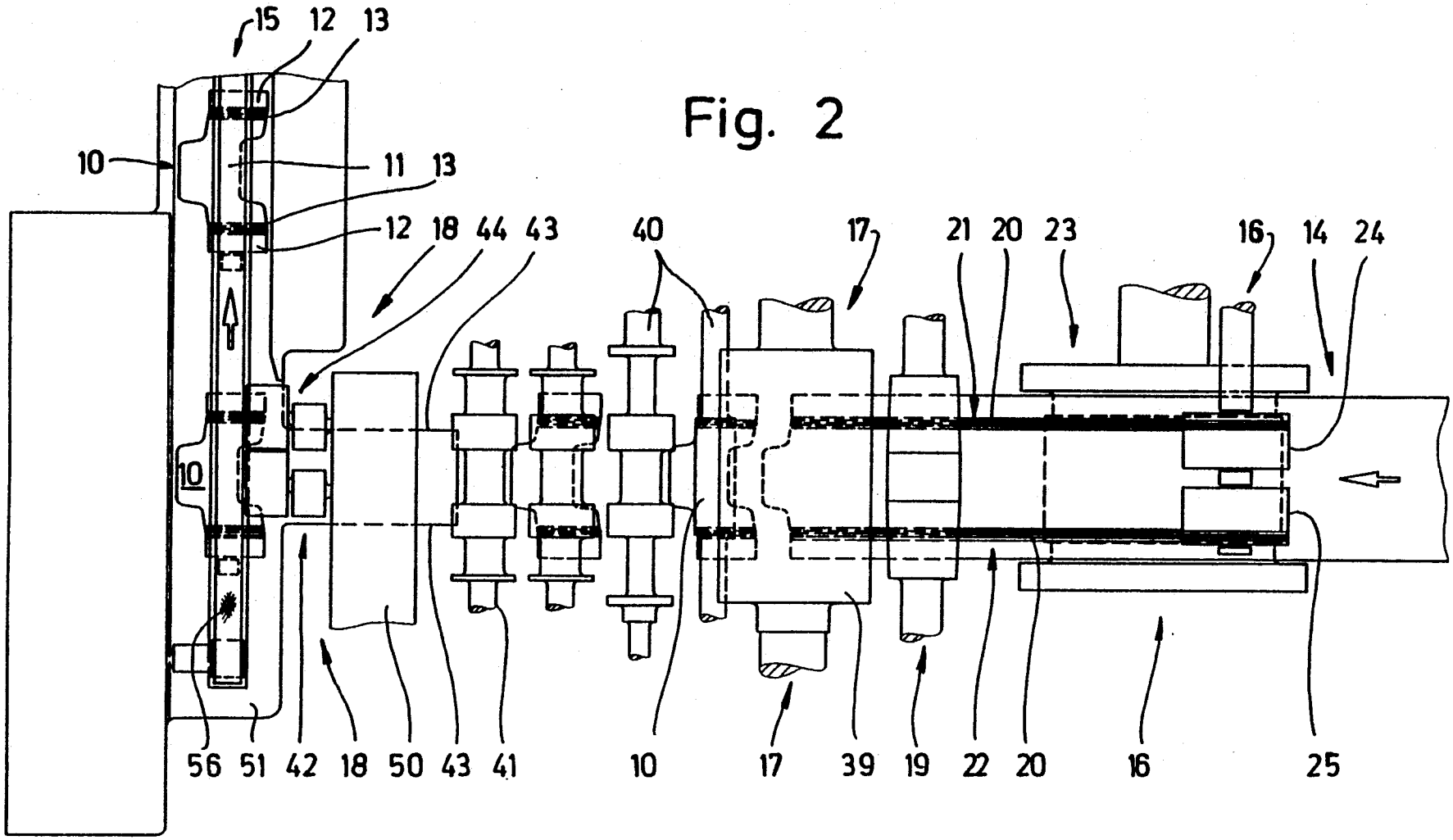
FIG. 2 shows a plan view of the apparatus according to FIG. 1.

The exemplary embodiment illustrated in the drawings is concerned with the production of hinge lid packs with rounded longitudinal edges, especially of the type according to U.S. Pat. No. 4,753,383. In particular, the present embodiment is concerned with the production and preparation of a collar 10 which is suitable for being introduced into such a hinge lid pack with rounded longitudinal edges. The collar 10 comprises a collar front panel 11 and collar side panels 12. Within the pack or prior to their introduction, the collar side panels 12 are moved to a position transverse to the collar front panel 11, so that longitudinal edges 13 are rounded.

The collars 10 are successively severed from a web of material 14 made from thin cardboard and are treated so as to be preshaped. Thereafter, the collars 10 are fed to further packaging units, for example to an apparatus as disclosed in U.S. Pat. No. 4,612,756, by means of a collar conveyor 15.

The shown apparatus comprises an embossing station 16 which is followed in the conveying direction by a cutting station 17 and a shaping station 18.

The web of material 14 is as wide as the collars 10 which are to be made and is drawn off a reel (not shown), particularly by means of drawing rollers 19 which are arranged downstream of the embossing station 16 in the conveying direction. Thus, the web of material 14 is continuously drawn through the embossing station 16 by the drawing rollers 19.

In the region of the embossing station 16, the web of material 14 is continuously provided with narrowly spaced side-by-side grooves 20. The web of material 14 is deformed in the region of two parallel embossed strips 21 and 22, such that a plurality of such grooves 20 is closely located next to one another. Here, the grooves 20 are formed into the material from both sides. In the course of the further manufacturing process, the rounded longitudinal edges 13 are formed in the region of the grooves 20 or the embossed strips 21, 22 comprising these grooves 20.

The embossing station 16 has appropriate embossing tools, particularly a lower embossing roller 23 and upper embossing rollers 24 and 25. The embossing roller 23, which in the present case is arranged below the web of material 14, has a greater diameter than the embossing rollers 24 and 25 which act as counter rollers. The web of material is guided within a depression in a jacket wall 27 of the embossing roller 23. Lateral rims 28 delimit the depression 26. Two scoring rings 29 and 30 are formed in the outside of the jacket wall 27 within the depression 26. These scoring rings 29, 30 extend all around the roller and are spaced at a distance which corresponds to the distance between the embossed strips 21, 22.

The upper (counter) embossing rollers 24, 25 are designed as simple cylindrical rollers and are also each provided with a scoring ring 31, 32 at their outer peripheries. These upper scoring rings 31, 32 correspond to the scoring rings 29, 30 of the embossing roller 23, such that embossing ribs 33 (FIG. 5) are arranged offset to one another, so that grooves are applied to the material which is thus deformed.

The embossing rollers 23, on the one hand, and 24, 25, on the other hand, are idling on stationary axles 34 and 35. The upper embossing rollers 24, 25 are designed as single rollers and are mounted on the axle 35 with clearances relative to lateral guides (shoulder 36). The clearance allows small lateral movements of the embossing rollers 23, 24, 25. As a result of this play, the embossing tools, i.e. the embossing ribs 33 of confronting scoring rings 29 and 31 or 30 and 32, respectively, can adjust themselves to one another. The embossing rollers 23, on the one hand, and 24 and 25, on the other hand, are spaced apart at such a distance, that a force is applied which deforms the material of the collar 10. In order to create the parallel grooves 20, the embossing ribs 33 of the interacting embossing rollers 23, 24, 25 are arranged offset to one another.

Figure 5:
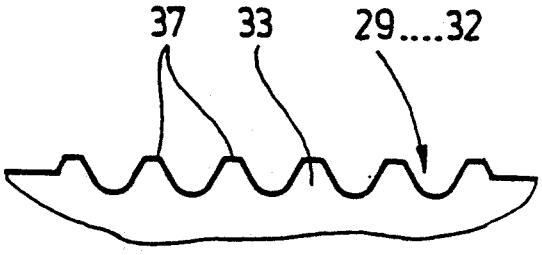
FIG. 5 shows a cross-sectional detail of embossing tools, on a very enlarged scale

The greatly enlarged representation of FIG. 5 shows the structure of the scoring rings 29, 30, 31 in detail. Embossing ribs are provided with a flat portion 37 at their radially outward sides, so that they do not act like a blade and cut into the cardboard of the collar. The center-to-center distance between the embossing ribs 33 is (about) 1 mm. The width of the flat portion 37 is in this case about 0.1 mm.

The web of material 14 is drawn through between the embossing rollers 23, on the one hand, and 24, 25, on the other hand, by drawing rollers 19 which are located downstream of the embossing station 16. In the conveying direction, the drawing rollers 19 are followed by the cutting station 17 which in this case comprises two opposite cutting rollers 38, 39. Blades, which are arranged on the periphery of these cutting rollers 38, 39, correspond to the cutting contour and therewith the specific design of the collars 10. The individual collars 10 are made when the web of material 14 is transported through between the cutting rollers 38, 39 and are further transported by following conveying rollers 40 at a slightly greater speed than the web of material 14. As a result, the collars 10 are fed to the shaping station 18 at a distance from one another which is increasing.

Conveyor rollers 41 convey the collar within the shaping station 18 to a cantilever shaping plate 42 which is only supported at the end. This shaping plate 42 is adapted to the design and the dimensions of the collar 10. Longitudinal edges of the shaping plate 42 are designed as round edges 43 which extend in the region of the embossed strips 21, 22 and thus in the region of the round edges which are to be formed. This means that the collar side panels 12 laterally project from the shaping plate 42.

On both sides of the shaping plate 42, shaping tools press the collar side panels 12 down about the round edges 43 and below the shaping plate 42. For this purpose, a special shaping unit 44 is provided which comprises two shaping rollers 45 which are movable transversely across the shaping plate 42. The axis of rotation of these shaping rollers 45 extends in the conveying direction of the collar 10.

In order to deform the collar side panels 12 in the afore described way, the shaping rollers 45 are placed approximately centrally onto the collar 10 resting on the shaping plate 42 from above and are then moved towards the edges, i.e. the round edges 43, in opposite directions and are moved along these edges to the bottom side of the shaping plate 42. In this process, the collar side panels 12 are folded such that rounded portions are formed in the region of the embossed strips 21, 22, which portions correspond to the shape of the round edges 43.

After this shaping process, the shaping rollers 45 are moved back in the opposite direction to their initial position, specifically at a distance above the shaping plate 42. For this purpose, each shaping roller 45 is attached to an actuating arm 46 of the shaping unit 44. Each actuating arm 46 is movable in the form of a parallel displacement by means of two crank mechanisms 47, 48 which are driven by a drive 49 which has a reciprocating effect and is located within a transmission casing 50.

As a result of the restoring forces of the material, the collar side panels 12 which were deformed in the afore described way return to a position in which they are at an obtuse angle relative to the collar front panel 11. In this position, the collar 10 is pushed onto a discharge plate 51. This intermittent conveying movement of the collar is conducted by a conveying lever 52 which is located essentially below the transport plane of the collar 10. The conveying lever 52 engages one collar 10 on the shaping plate 42 at a time and pushes the collar onto the discharge plate 51 by means of an anticlockwise pivoting movement.

Two of these conveying levers 52 are provided, so that one conveying lever 52 is movable on each side of the shaping plate 42. Moreover, the two conveying levers 52 are movable transverse to the conveying direction, which means they are spreadable. As a result, the conveying levers 52 can be laterally moved past a following collar 10 located on the shaping plate 42 when they return to their initial position at the rear end of the collar 10.

Figure 4:
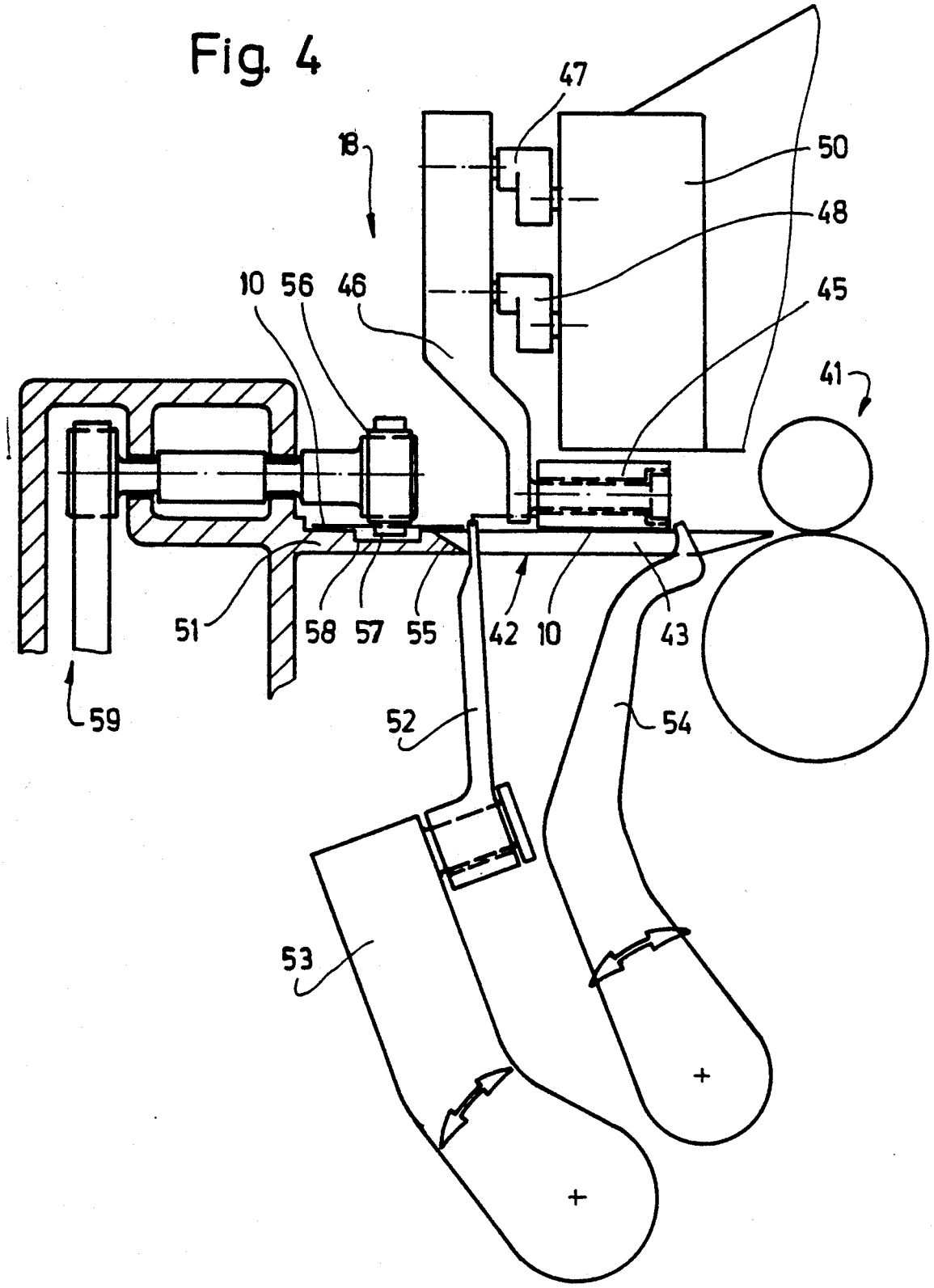
FIG. 4 shows a side view of the shaping station, also on an enlarged scale.
Figure 3:
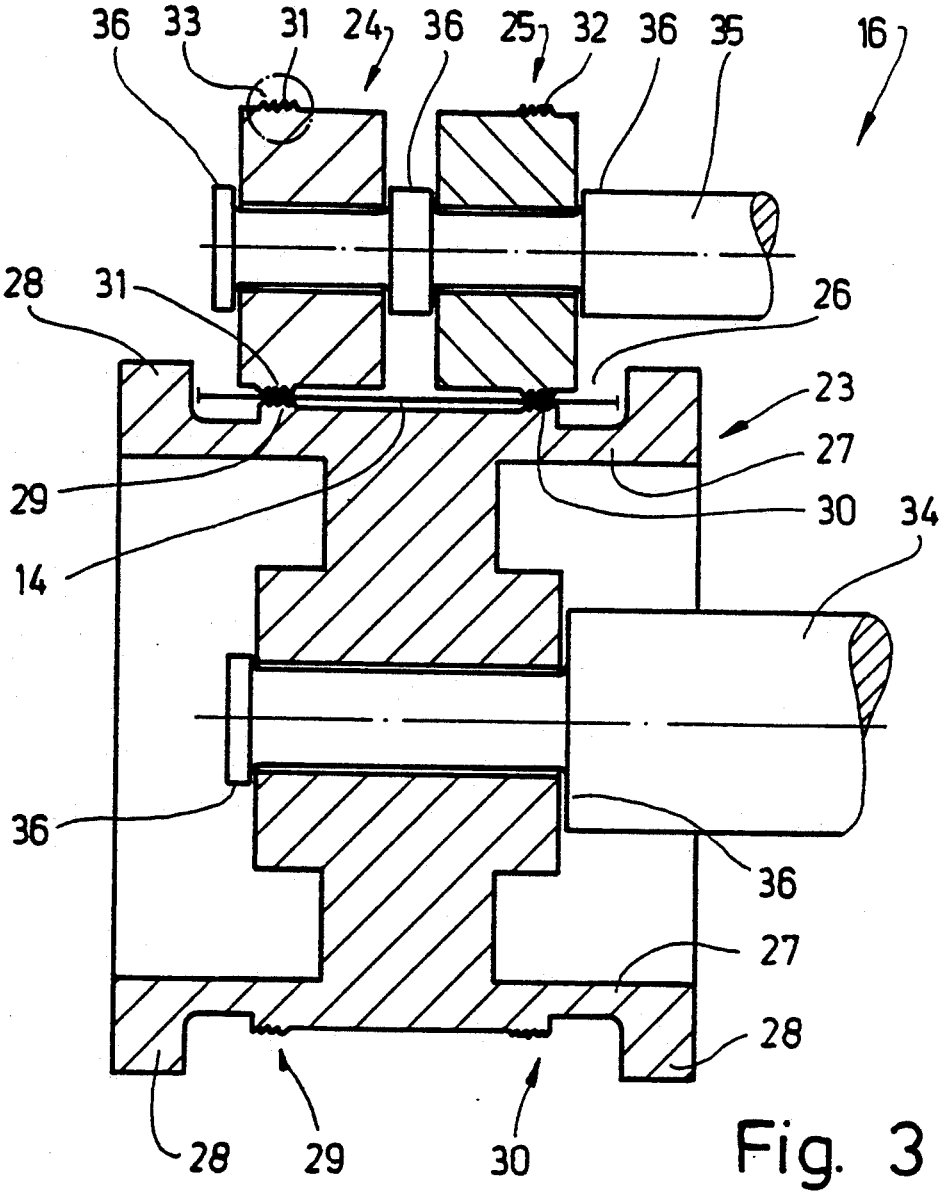
FIG. 3 shows a cross-section of the means of the embossing station, taken along line III—III of FIG. 1, on an enlarged scale.

In the present embodiment, a pivoting lever 54 which is also mounted essentially below the shaping plate 42 is provided to transport the collar 10 to its accurate position on the shaping plate 42. Expediently, there are also two of these pivoting levers 54 and they extend with an upper hook-shaped driver end on both sides of the shaping plate 42. The pivoting lever 54 is movable from its initial position in the region of the conveying rollers 41 as illustrated in FIG. 1 to the position of FIG. 4 which corresponds to the accurate position of the collar 10 on the shaping plate 42.

When the deformed collar 10 is pushed onto the discharge plate 51, the downwardly directed collar side panels 12 run up on an inclined shaping surface 55 at the edge of the discharge plate 51 and are thus reshaped to a nearly horizontal position.

In this nearly horizontal orientation, but with preshaped longitudinal edges 13, the collar 10 located on the discharge plate 51 is discharged by the collar conveyor 15 transverse to the previous conveying direction. For this purpose, the collar conveyor 15 is equipped with a conveyor belt, preferably a toothed belt 56, which comprises drivers 57 on its outer side. Each of these drivers 57 engages one collar at its confronting edge. The toothed belt 56 is located above the discharge plate 51, such that the collars 10 are transported with the lower strand of the toothed belt 56. The discharge plate 51 is provided with a channel-like depression 58 in the region of the toothed belt 56.

A drive 59 for the toothed belt 56 is arranged laterally next to the collar conveyor 15.

The collars 10, which have been preshaped in the described way in the region of the longitudinal edges 14 to be formed, that is to say in the region of the embossed strips 21, 22, can now be further processed in the conventional way. In particular, they can be placed onto a cigarette block (a cigarette group wrapped in a tin foil blank). In the further course of the manufacturing process, the laterally projecting collar side panels 12 are folded against the side faces of the cigarette block which is then introduced into a pack (hinge lid pack), for example in the way described in U.S. Pat. No. 4,612,756.

In the production of collars for packs having for example an octagonal cross-section, i.e. packs with bevelled longitudinal edges as disclosed in U.S. Pat. No. 4,753,384, the two longitudinal edges forming the bevel are—in contrast to the afore described exemplary embodiment—not created by embossing or scoring the material, but by means of a punch line, similar to a perforation. The two parallel perforation lines for each longitudinal edge are expediently applied in the region of the cutting station 17. Along its periphery, the cutting roller 39 can be equipped with cutting edges which apply perforation lines to the collar 10.

Thereafter, the collar which has been prepared in this way is further processed and treated in the already described way.

We claim:

1. In a process for producing hinge-lid cigarette packs in which a collar (10), comprising a collar front panel (11) and collar side panels (12), partially projects from a pack part of the hinge-lid pack, in which process said collar (10) is placed, in the form of a separate flat blank, onto a top side of a cigarette block which forms the pack contents and which consists of a cigarette group wrapped in an inner wrapper, in such a way that the projecting collar side panels (12) of the blank are folded against corresponding side faces of the cigarette block which is then introduced into the hinge-lid pack together with the folded collar (10), an improvement for making a collar (10) having, between the collar front panel and the collar side panels, rounded or polygonal longitudinal edges corresponding to those of a hinge-lid pack, comprising:

forming in the blank, in regions thereof corresponding to said longitudinal edges of the collar (10), grooves (20) or edge embossments;

preshaping the collar (10) in a shipping station (18) by pivoting the projecting collar side panels of the blank (12) relative to the collar front panel (11), thereby forming the rounded or polygonal longitudinal edges (13) of the collar;

after said preshaping of the longitudinal edges (13) of the collar (10), reshaping the collar (10) into one plane so as to resume an extended flat shape; and subsequently, feeding the collar blank, in its extended flat condition, to the cigarette block.

2. An apparatus for producing hinge lid packs with a collar, comprising a collar front panel (11) and collar side panels (12), which is inserted into a pack part of each hinge lid pack, said collar (10) being severable from a continuous web of material (14), feedable to a cigarette block forming the pack contents, and introducible into the hinge lid pack together with the cigarette block, characterized in that;

for the production of hinge lid packs with rounded or polygonal longitudinal edges, said web of material (14) is conveyable through an embossing unit for applying longitudinal grooves (20) in the region of longitudinal edges (13) between the collar front panel (11) and the collar side panels (12);

a cutting tool for severing blanks for the collar (10) is located downstream of said embossing unit;

downstream of a cutting station (17) or the cutting tool, there is arranged a shaping station (18) in which portions (embossed strips 21, 22), which are defined by grooves (20) and which are to form the rounded or bevelled longitudinal edges of the collar (10), are preshaped by pivoting of the collar side panels (12) about rounded or bevelled edges (round edges 43) of a shaping plate (42); and when the collar (10) is further transported after being treated in the shaping station (18), the collar side panels (12) are reshaped into a laterally directed and nearly flat position, especially by means of pushing said collar side panels (12) onto a platform or discharge plate (51) with inclined shaping surfaces (55).

3. The apparatus as claimed in claim 2, wherein the preshaped collar side panels (12) which are nearly extending in the same plane as the collar front panel (11) are dischargeable in the transverse direction by a transversely directed collar conveyor (15), especially a rotating conveyor belt (toothed belt 56) with drivers (57) for engaging one collar (10) each.

4. The apparatus as claimed in claim 2, wherein the collar (10) is pushable out of the shaping station (18) from the shaping plate (42) onto the discharge plate (51) by means of a pusher which is movable backwards and forwards in the direction of movement of the collar (10), especially by means of a conveying lever (52).

5. An apparatus for producing hinge lid packs with a collar, comprising a collar front panel (11) and collar side panels (12), which is inserted into a pack part of each hinge lid pack, said collar (10) being severable from a continuous web of material (14), feedable to a cigarette block forming the pack contents, and introducible into the hinge lid pack together with the cigarette block, characterized in that:

for the production of hinge lid packs with rounded or polygonal longitudinal edges, said web of material (14) is conveyable through an embossing unit for applying longitudinal grooves (20) in the region of longitudinal edges (13) between the collar front panel (11) and the collar side panels (12);

a cutting tool for severing blanks for the collar (10) is located downstream of said embossing unit;

downstream of a cutting station (17) or the cutting tool, there is arranged a shaping station (18) in which portions (embossed strips 21, 22), which are defined by grooves (20) and which are to form the rounded or bevelled longitudinal edges of the collar (10), are preshaped by pivoting of the collar side panels (12) about rounded or bevelled edges (round edges 43) of a shaping plate (42); and the collars (10) are pushable into a required position on the shaping plate (42) of the shaping station (18) by means of a pusher which is movable backwards and forwards in the conveying direction of the collars (10), especially by means of a pusher in the form of a pivoting lever (54) arranged below the conveying plane of the collar (10).

6. An apparatus for producing hinge lid packs with a collar, comprising a collar front panel (11) and collar side panels (12), which is inserted into a pack part of each hinge lid pack, said collar (10) being severable from a continuous web of material (14), feedable to a cigarette block forming the pack contents, and introducible into the hinge lid pack together with the cigarette block, characterized in that:

for the production of hinge lid packs with rounded or polygonal longitudinal edges, said web of material (14) is conveyable through an embossing unit for applying longitudinal grooves (20) in the region of longitudinal edges (13) between the collar front panel (11) and collar side panels (12);

a cutting tool for severing blanks for the collar (10) is located downstream of said embossing unit;

downstream of a cutting station (17) or the cutting tool, there is arranged a shaping station (18) in which portions (embossed strips 21, 22), which are defined by grooves (20) and which are to form the rounded or bevelled longitudinal edges of the collar (10), are preshaped by pivoting of the collar side panels (12) about rounded or bevelled edges (round edges 43) of a shaping plate (42); and the collar (10) rests on the shaping plate (42) in the shaping station (18) with its collar front panel (11), and wherein, by means of shaping rollers (45), the collar side panels (12) are pressable about shaping edges (round edges 43) which are designed to correspond to the shape of the longitudinal edges of the collar (10), such that the collar side panels (12) are pivotable approximately until they come to abut the bottom side of the shaping plate (42).

7. An apparatus for producing hinge lid packs with a collar, comprising a collar front panel (11) and collar side panels (12), which is inserted into a pack part of each hinge lid pack, said collar (10) being severable from a continuous web of material (14), feedable to a cigarette block forming the pack contents and introducible into the hinge lid pack together with the cigarette block, characterized in that:

for the production of hinge lid packs with rounded or polygonal longitudinal edges, said web of material (14) is conveyable through an embossing unit for applying longitudinal grooves (20) in the region of longitudinal edges (13) between the collar front panel (11) and collar side panels (12);

a cutting tool for severing blanks for the collar (10) is located downstream of said embossing unit;

the embossing unit comprises at least two embossing rollers (23, 24, 25) which are arranged on opposite sides of the web of material (14) and have projections and depressions extending along the periphery of said rollers in the region of the grooves (20) which are to be applied, and wherein the web of material (14) is conveyable through and between the embossing rollers (23: 24, 25); and two of said embossing rollers (24, 25) act as an embossing tool and are arranged on only one side of the web of material (14), especially above said web of material (14), and are rotatably mounted on a common axle (35) with a small lateral play.

8. The apparatus as claimed in claim 7, wherein downstream of a cutting station (17) or the cutting tool there is arranged a shaping station (18), in which portions (embossed strips 21, 22) which are defined by grooves (20) and which are to form the rounded or bevelled longitudinal edges of the collar (10) are preshapable by means of pivoting the collar side panels (12) about rounded or bevelled edges (round edges 43) of a shaping plate (42).

9. The apparatus as claimed in claim 7, wherein all of the embossing rollers (23; 24, 25) are mounted to freely rotate and are rotatingly driven by means of the web of material (14) conveyed through between said embossing rollers (23; 24, 25), and wherein drawing rollers (19) for drawing and thus transporting the web of material (14) are preferably located downstream of the embossing rollers (23; 24, 25) in the direction of transport.

* * * * *